US006844494B1

(12) United States Patent
Nevins

(10) Patent No.: US 6,844,494 B1
(45) Date of Patent: Jan. 18, 2005

(54) ORGANIZER FOR USE IN THE CHARGING OF ELECTRICALLY OPERATED CONSUMER PRODUCTS

(76) Inventor: Jason Nevins, 205 Commack Rd., #1013, Commack, NY (US) 11725

( * ) Notice: Subject to any disclaimer, the term of this patent is extended or adjusted under 35 U.S.C. 154(b) by 0 days.

(21) Appl. No.: 10/799,123

(22) Filed: Mar. 15, 2004

(51) Int. Cl.[7] ..... H01R 13/46
(52) U.S. Cl. ..... 174/53; 174/135; 439/490
(58) Field of Search ..... 174/53, 135; 439/490, 439/502, 501, 577; 320/111; 361/643, 600

(56) References Cited

U.S. PATENT DOCUMENTS 4,924,032 A * 5/1990 Akins ..... 174/53
5,590,019 A * 12/1996 Fox et al. ..... 361/643
5,847,541 A * 12/1998 Hahn ..... 320/111
5,917,694 A 6/1999 Denny
6,548,986 B1 * 4/2003 Jakubowski ..... 320/111
6,710,254 B2 * 3/2004 Yueh ..... 174/135

* cited by examiner

*Primary Examiner*—Dhiru R. Patel
(74) *Attorney, Agent, or Firm*—Myron Amer. P.C.

(57) ABSTRACT

An organizer serving as a safeguard for electrical cords during charging intervals of electrically-operated consumer products provided by a compartment having internally a strip of uniformly spaced apart female sockets electrically connected to a power company wall socket and externally the consumer products' charging components similarly uniformly spaced apart, wherein the correlation of the uniform spacing maintains the electrical cords in neatly coiled conditions without entanglement with each other within the compartment.

1 Claim, 3 Drawing Sheets

ORGANIZER FOR USE IN THE CHARGING OF ELECTRICALLY OPERATED CONSUMER PRODUCTS

The present invention relates generally to improvements for electrically operated consumer products, the improvements more particularly contributing to facilitating the preparation of these prods for their intended end use.

BACKGROUND OF THE INVENTION

1. Field of the Invention

Exemplified perhaps best by hair care appliances, such as hair dryers and hair curlers, is their management using an "Appliance Organizer" as illustrated and described in U.S. Pat. No. 5,917,694 issued to Denny on Jun. 29, 1999, as but one of many such patents. Using to advantage that the appliances are typically used at a common site, such as before a bathroom sink and minor, there is positioned at the site a holder of the appliances which also organizes the electrical cords thereof so there is minimal entanglement.

2. Description of the Related Art

However, equally popular are such consumer products also electrically operated, as exemplified by digital cameras, cell phones, walkie-talkies, MP3 players and like products, which are battery-powered to promote portability. These category of products lacking a common site of use, correspondingly lack an organizer, not only to obviate electric cord entanglement but to safeguard against hazards during preparation for use.

BRIEF SUMMARY OF THE INVENTION

Broadly, it is an object of the present invention to overcome the foregoing and other shortcomings of the prior art.

More particularly, it is an object to use to advantage an equivalent of a common site of use, namely, a makeshift common site for the charging of the batteries of the noted portable consumer products, and to thereby obtain the same benefits of an "organizer", all as will be better understood as the description proceeds.

BRIEF DESCRIPTION OF THE SEVERAL VIEWS OF THE DRAWINGS

The description of the invention which follows, together with the accompanying drawings should not be construed as limiting the invention to the example shown and described, because those skilled in the art to which this invention appertains will be able to devise other forms thereof within the ambit of the appended claims.

DETAILED DESCRIPTION OF THE INVENTION

Figure 1:
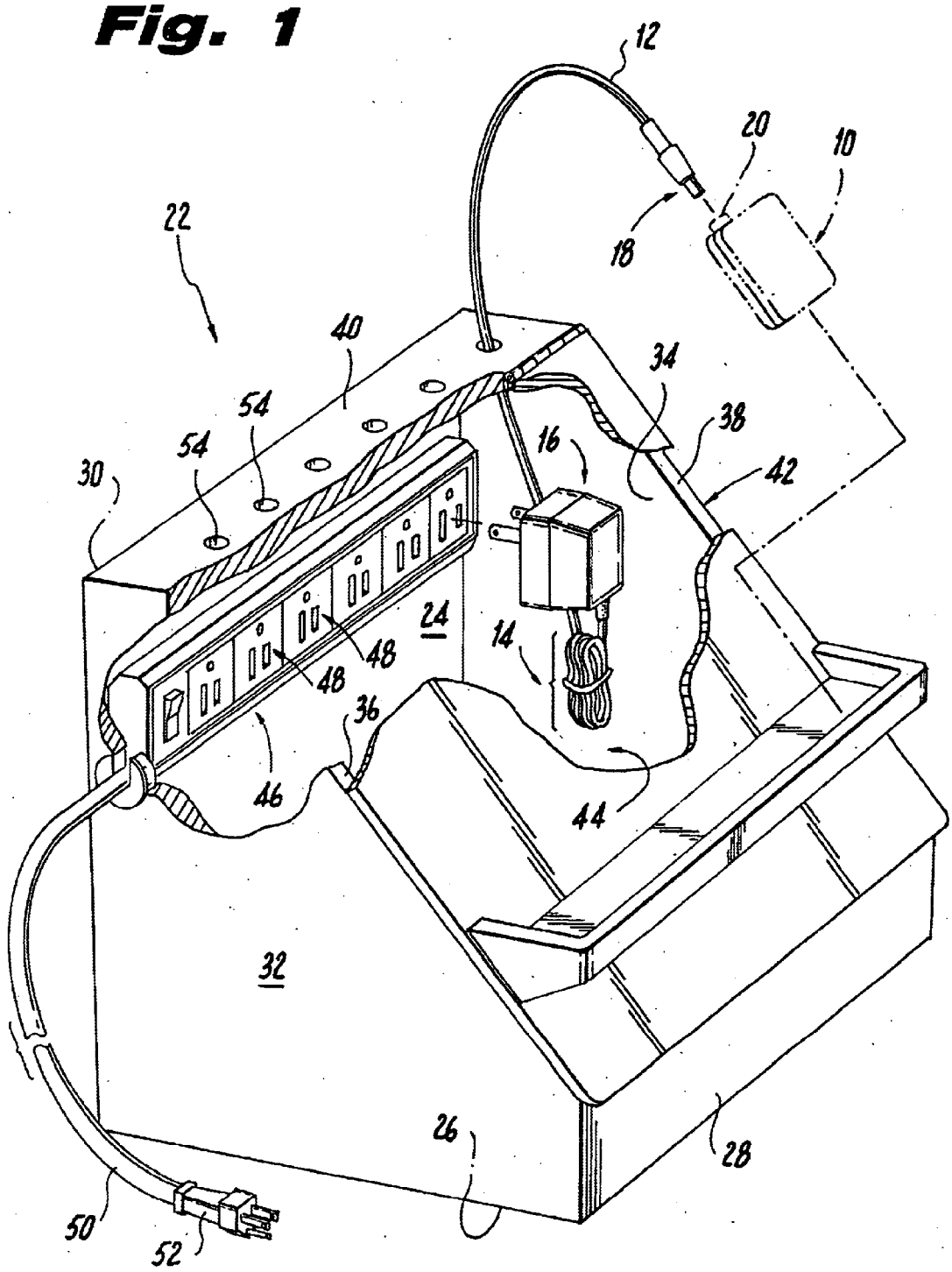
FIG. 1 is a perspective view, with portions broken away to illustrate internal structural features, of an organizer for electrical cords of electrically-operated consumer products according to the present invention.

In popular use are electrically operated articles of manufacture, as shown in FIG. 1, exemplified by digital cameras, cell phones, walkie-talkies, and like products, individually and collectively designated 10, which have as an auxiliary component an electric cord 12 typically 3 to 5 feet in length 14 and having a male plug 16 at one end and a charging insert 18 at an opposite end, the latter sized and shaped to be projected into a cooperating sized and shaped socket 20 in the product 10 so that batteries or like electrical components (not shown) of the product 10 are charged with electrical energy preparatory to functioning in the manner intended, as for example, a charged digital camera product 10 to provide photographing service, a charged cell phone product 10 to provide communicating service, and so on.

Addressing the chore of charging the products 10 from time to time, as needed, is an article of manufacture of what aptly, going by its function, serves as an organizer illustrated and generally designated 22 in FIG. 1, provided in accordance with the present invention to handle the plural electrical cords 12 without entanglement with each other, in proper electrical connection, with a cooperating product 10, and in a typically unsupervised set aside duration for the charging in a safeguarded environment against injury to children, pets or those otherwise vulnerable by exposure to the electrical connections involved, as well as obviating the hazards of fire of flammable materials.

The safe environment of the organizer 22 is provide by an interior compartment 24 bounded by a bottom 26, a short front wall 28, a taller rear wall 30, opposite side walls 32 and 34 of a trapezoidal shape presenting angled edges 36 and 38, and a top wall 40, the edges, individually and collectively designated 42, of the walls bounding an opening 44 into the compartment 24. Mounted on the rear wall 30 is a horizontally oriented power strip 46 of uniformly spaced apart female electrical sockets, individually and collectively designated 48, of a type commercially available, as from The Home Depot of 1608 Sunrise Highway, Freeport, N.Y., and including an electrical cord 50 electrically connected at one end to the sockets 48 and at an opposite end to a male plug 52.

Figure 2:
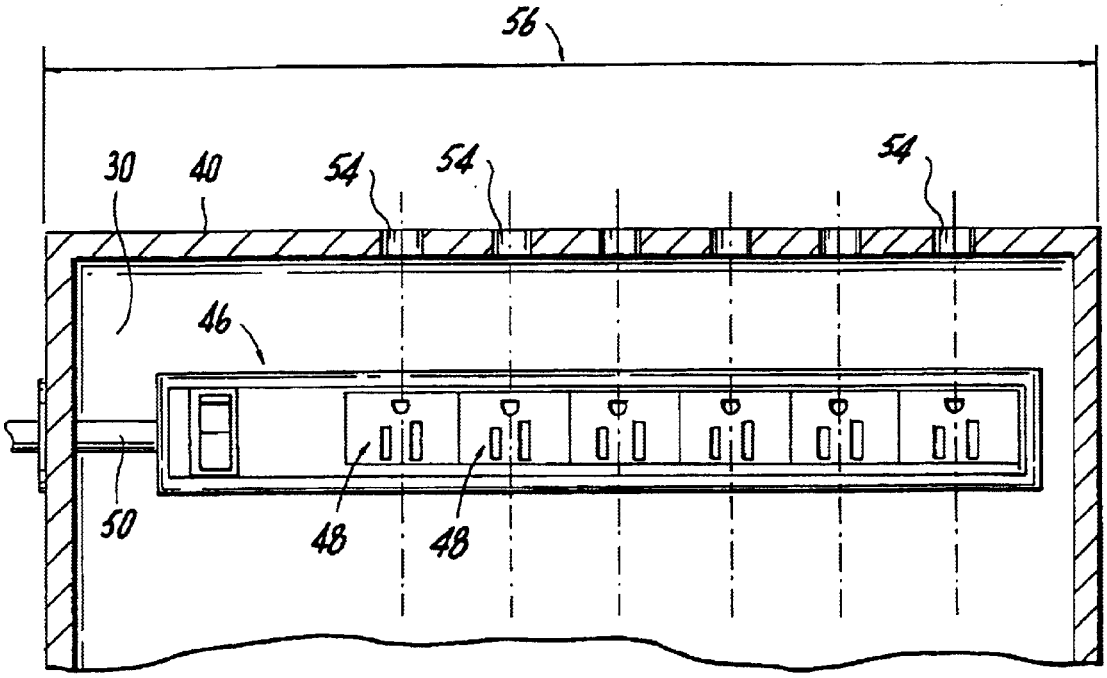
FIG. 2 is a partial front elevational view of a spaced apart string of female electrical sockets component to the organizer.

In correlation to the uniform spacing of the female sockets 48 is an array of similarly uniformly spaced apart edges bounding shaped openings, individually and collectively designated 54, in the top wall 40, so that the correlation produces an alignment of a cooperating opening 54 with a female socket 48 in plural vertical planes successively across the width 56 of the wall 40, as shown in FIG. 2.

Figure 3:
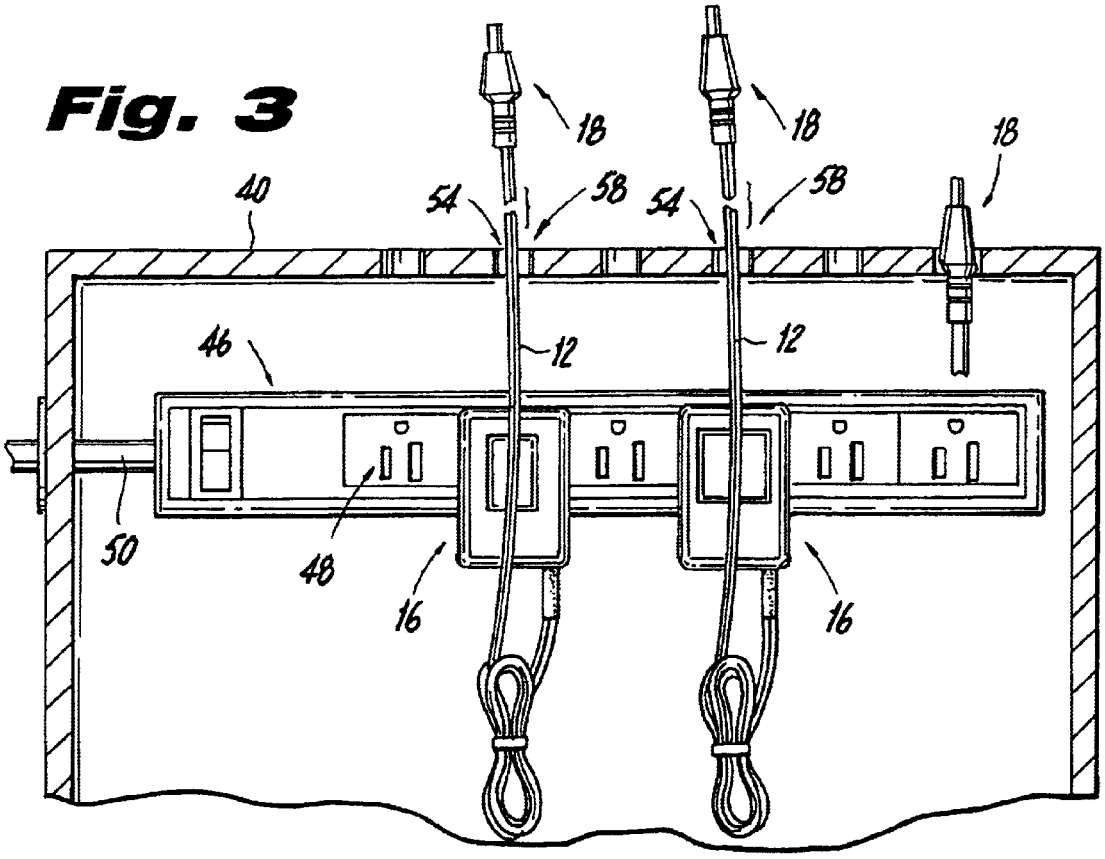
FIG. 3 is a view similar to FIG. 2 and including electrical cords of electrically-operated consumer products.

As best seen in FIG. 3, the use of the organizer 22 contemplates the threading of the male plug 16 of an electrical cord 12 through a selected opening 54 and the electrical connection of the male plug 16 to a cooperating, or same vertical plane, female plug 48 on the strip 46. The charging means ends 18 of the electrical cord 12 is then inserted in a force fit in the opening 54, as noted at 58 and, to this end since the charging means end 18 is usually shaped and of a selected size as supplied by manufacturers thereof, the openings 54 are of a matching shape and size to provide the noted friction fit 58. The trade practice of sizing and shaping the electric cord charging means end 18 as just noted is best understood from U.S. Pat. No. 6,495,988 for "Combination Charging Mechanism" incorporated herein pursuant to MPEP 2163.07(b)

Figure 4:
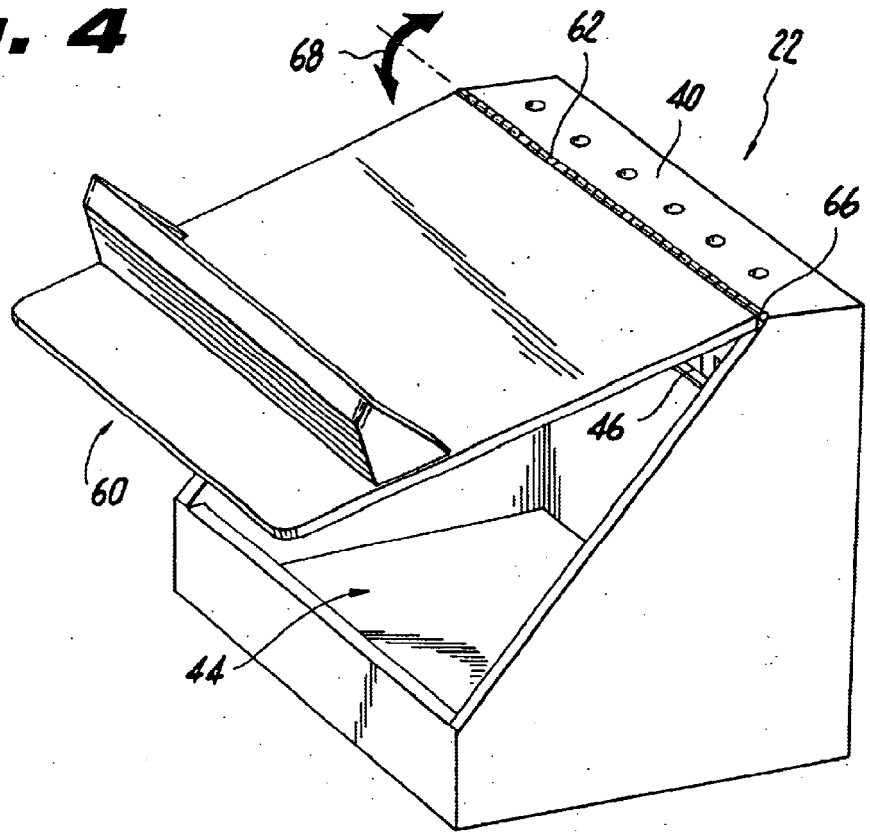
FIG. 4 is a perspective view of the organizer similar to FIG. 1 but without the portion thereof broken away in FIG. 1.

Completing the construction of the organizer 22 is a cover or lid 60 hingedly connected, as at 62, to the free edge 66 of the top wall 40 so as to partake of opening and closing movements 68 in the compartment opening 44, as shown in FIG. 4. When closed, lid 60 is an angled support surface for products 10 held in place against a stop in a strip 70 connected horizontally across the lid 60, best seen in FIG. 5.

Figure 5:
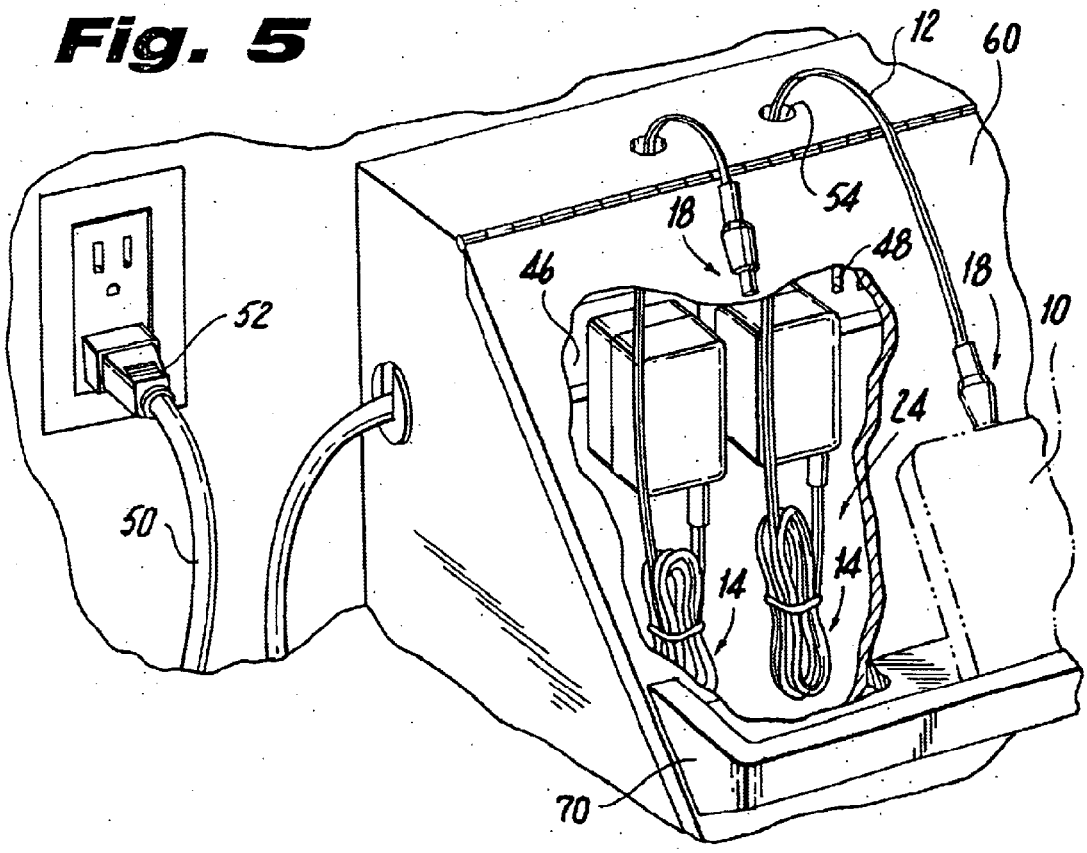
FIG. 5 is a partial perspective view illustrating the electrical cords of FIG. 3 and also the electrically-operated consumer products.

Preparatory to a charging interval, typically at night, with the power strip male plug 52 inserted in a power company line current female wall socket, as seen in FIG. 5, one or more products 10 are disposed in place on the closed slanted lid 60 and cooperating cord electrical charging ends 18 removed from the openings 54 and connected to the products 10, with the lengths 14 of the cords 12 each maintained in a neat coiled and untangled condition from each other in their delimited vertical planes within the storage compartment 24. The electrical charging ends 18 not in active use remain in their non-use positions in the openings 54 and, as such, pose no more of a danger than an unused wall female socket, while the active female sockets 48 of the power strip 46 are within the safeguard of the compartment 24.

While the organizer herein shown and disclosed in detail is fully capable of attaining the objects are providing the advantages hereinbefore stated, it is to be understood that it is merely illustrative of the presently preferred embodiment of the invention and that no limitations are intended to the detail of the construction or design herein shown other than as defined in the appended claims.

What is claimed is:

1. An organizer for electrical cords of electrically-operated consumer products comprising:

A. a storage compartment bounded by a bottom and upstanding four walls extending therefrom having edges in turn bounding an opening into said storage compartment;

B. a strip of selected uniformly spaced apart female electrical sockets supported within said storage compartment in a horizontal orientation on one of said walls;

C. a cover hingedly mounted for open and closing movements in said storage compartment opening;

D. an array of selected uniformly spaced apart edges in said cover each one of said edges being in a shaped configuration of a selected size bounding openings into said storage compartment;

E. a uniform expanse of a spaced apart relation of said female electrical sockets and of said array of said openings of said cover selected to be approximately the same so as to position said sockets and openings in alignment with each other;

F. plural electrical cords each of a selected length having respectively at opposite ends a male electrical plug and a shaped electrical charging means of a selected size;

G. operative positions of said electrical cords disposed within said storage compartment with:

1. said male electrical plug inserted in a cooperating female socket, and
2. said sizes of said electrical changing means selected with respect to a corresponding size of a said cover opening so as to have said electrical charging means projected in a friction fit in protruding relation from said cover opening;

whereby a protruding electrical changing means is adapted to be manually inserted in a consumer product and another left remaining in a non-use position, and said electrical cords thereof are both orderly stored within said storage compartment.

* * * * *